US006292068B1

(12) United States Patent
Martin

(10) Patent No.: US 6,292,068 B1
(45) **Date of Patent: *Sep. 18, 2001**

(54) E-PLANE WAVEGUIDE CIRCULATOR WITH A FERRITE IN THE TOTAL HEIGHT OF THE REDUCED HEIGHT REGION

(75) Inventor: Siegbert Martin, Oppenweiler (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/234,666

(22) Filed: Jan. 19, 1999

(30) Foreign Application Priority Data

Jan. 21, 1998 (DE) ..... 198 02 070

(51) Int. Cl.[7] ..... H01P 1/39
(52) U.S. Cl. ..... 333/1.1
(58) Field of Search ..... 333/1.1

(56) References Cited

U.S. PATENT DOCUMENTS 3,136,962 * 6/1964 Bowness ..... 333/1.1
3,492,601 * 1/1970 Omori ..... 333/1.1
4,633,199 12/1986 Stevens et al. ..... 333/1.1

FOREIGN PATENT DOCUMENTS 944645 12/1963 (GB) .
2 201 044 8/1988 (GB) .

OTHER PUBLICATIONS

"Microwaves and HF Magazine" vol. 16, No. 2. 1990, pp. 168–173.

J. Helszajn: "Common Waveguide Circulator Configurations", Electronic Engineering., BD. 46, NR. 559, Sep. 1974, pp. 66–69, XP002099527, pp. 66, 69.

* cited by examiner

*Primary Examiner*—Justin P. Bettendorf
(74) *Attorney, Agent, or Firm*—Michael J. Striker

(57) ABSTRACT

An E-plane waveguide-circulator has a height-reducing branching region, a ferrite body located in the branching region so that a magnetic field extends through the ferrite body, the ferrite body being formed as a bar which extends through a total height of the branching region.

6 Claims, 1 Drawing Sheet

E-PLANE WAVEGUIDE CIRCULATOR WITH A FERRITE IN THE TOTAL HEIGHT OF THE REDUCED HEIGHT REGION

BACKGROUND OF THE INVENTION

The present invention relates to an E-plane waveguide circulator having a high-reducing branching region, in which a ferrite body extending through a magnetic field is arranged.

Such E-plane waveguide circulators are disclosed for example in "Microwaves and HF Magazine" Volume 16, No. 2, 1990, pages 168–173. Three waveguide arms of one or two ferrite discs are inserted in the branching region. The thickness of the ferrite disc or discs corresponds only to a fraction of a total height of the branching region. Moreover, the height of the branching region is reduced by insertion of a metal disc on its upper and lower side. The advantage of the E-plane circulator when compared with the H-plane circulator is that at high frequencies an extremely low throughgoing damping is provided. Moreover, the E-plane circulators are of a relative small band (band width of no more than 1%). Moreover, the E-plane circulators which are realized nowadays require large magnets for producing the required magnetization of the ferrite material. At high frequencies, the height of the ferrite discs acts critically on the microwave behavior of the circulator. When an adjustment of the circulator is dispensed with, then for the height of the ferrite discs a tolerance of less than 0.01 MM must be maintained.

SUMMARY OF THE INVENTION

Accordingly, it is an object of the present invention to provide an E-plane waveguide circulator which avoids the disadvantages of the prior art.

In keeping with these objects and with others which will become apparent hereinafter, one feature of present invention resides, briefly stated in a E-plane waveguide circulator in which the ferrite body is formed as a bar which extends over the entire height of the branching region.

When the E-plane waveguide circulator is designed in accordance with the present invention it avoids the disadvantages of prior art. With such a bar-shaped ferrite body, a field distribution is provided in the branching region, which field distribution does not allow a flow of a wall current in a symmetrical plane perpendicular to the longitudinal axis of the ferrite bar extending separating plane. Thereby the circulator can be assembled from two shells, and the manufacture of the circulator is substantially facilitated. In addition it is possible to place one or several permanent magnets directly on the end sides of the ferrite bar. No waveguide wall is located between the magnets and the ferrite material, so that for the required magnetization of the ferrite material smaller magnets are needed.

In accordance with another feature of the present invention, one or several webs can extend into the branching region of the circulator to increase the dimensioning of the band width of the circulator.

The circulator can be assembled of two shells, with one shell provided with a depression for receiving one end of the ferrite bar. An opening is provided in the other shell at the side which is opposite to the depression, so that the ferrite bar can be inserted from outside into the branching region. The depression corresponds, with a narrow tolerance, to the cross-section of the ferrite bar and the opening has a space with respect to the cross-section of the ferrite bar.

Fixation of the ferrite bar in the opening is performed by an elastic ring placed around the ferrite bar. This arrangement of the ferrite bar together with the magnets at the end sides of the ferrite bar, provides for a possibility of a temperature expansion of different materials in the longitudinal direction of the ferrite bar and facilitates the mounting of the finished circulator, since the ferrite bar with the magnets can be inserted in a simple manner from outside into the branching region and fixed there.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
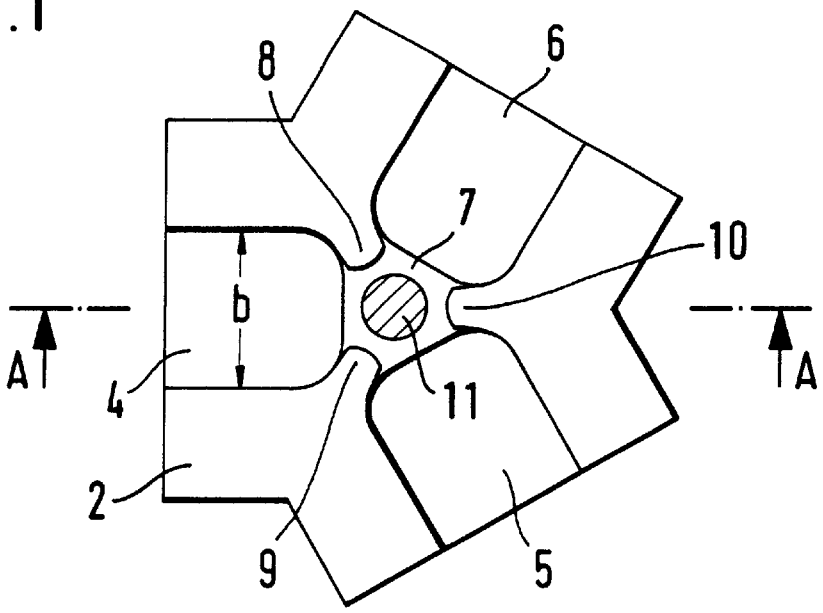
FIG. 1 is a view showing a section along the line B—B shown in FIG. 2 parallel to small sides of a waveguide circulator in accordance with the present invention.
Figure 2:
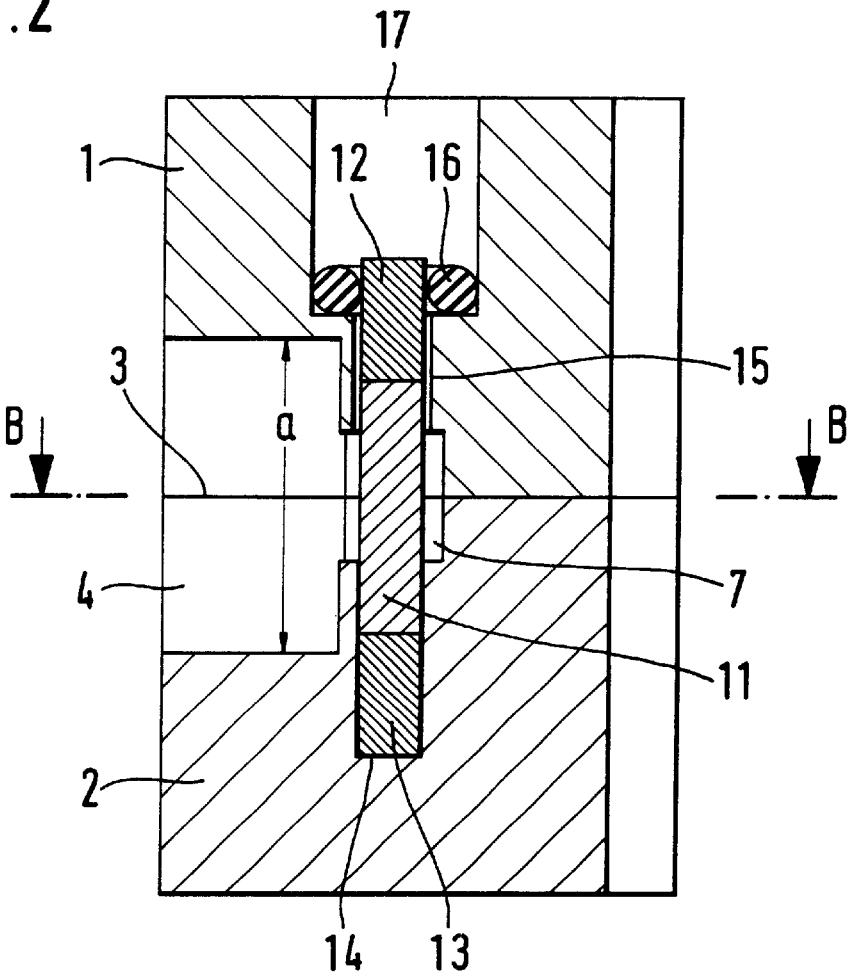
FIG. 2 is a view showing a section taken along the line A—A shown in FIG. 1 parallel to wide sides of the waveguide circulator in accordance with the present invention.

FIGS. 1 and 2 show two cross-sections A—A and B—B of an E-plane waveguide circulator, which are located orthogonal to one another. FIG. 1 shows a cross-section B—B which is parallel to the small side b of the waveguide, while FIG. 2 shows a cross-section A—A which is parallel to the wide side a of the waveguide.

The advantages for manufacture of the circulator in accordance with the present invention are provided since it is composed of two separately produced shells 1 and 2 as shown in FIG. 1 which can be assembled to form a finished circulator. The separating plane 3 between both shells 1 and 2 extends in a symmetrical plane parallel to the small sides b of the waveguide. Since the cross-section B—B is located in the separating plane, the FIG. 1 shows the view on the lower shell 2 of the circulator.

The waveguide circulator has three waveguide branch arms 4, 5, 6 as known in the art. All three waveguide branch arms 4, 5, 6 open in the center of the circulator in a branching region 7. It is characteristic for an E-plane waveguide circulator, that the small sides b of all waveguide branch arms 4, 5, 6 are located in the same parallel planes, in contrast to the H-plane circulator, in which the wide sides a of all waveguide branch arms are located in parallel planes.

As shown in FIG. 2, the branching region 7 is reduced in its height. Moreover, as shown in FIG. 1, webs 8, 9, 10 extend laterally in the branching region 7. In deviation from the above shown embodiment, also less than three webs can be provided. Since the branching region 7 is formed as a web waveguide, with the corresponding dimensioning of the webs 8, 9, 10 the band width of the waveguide is increased because disturbance modes which conventionally occur are substantially reduced by the webs.

A ferrite bar 11 is so arranged in the branching region 7 that it extends over the total height of the branching region 7 as can be seen from FIG. 2. With the ferrite bar 11 arranged in accordance with the present invention, such a field distribution is formed in the circulator, that no wall current flows in the separating plane 3. This is why it is possible that between both shells 1 and 2 of the circulator no galvanic contact must be produced. A gap can be provided between both shells 1 and 2 without affecting the electrical properties of the circulators. Since no electrical contacting is required for the shells 1, 2, it is not necessary to maintain during the manufacture a high flatness of the separating plane. Also no great attention has to be paid to the connection of the shells. In other words, less screws can be required for the force-transmitting connection of the shells.

The ferrite bar 11 which can be for example round and also can have any other cross-sectional contour, has such a size with respect to its cross-section that in the further passages 14 and 15 for the ferrite bar 11 and the shells 1, 2 no waves of operational frequency of the circulator propagates. For this purpose the permanent magnets 12 and 13 required for the magnetization of the ferrite can be arranged on the end sides of the ferrite bar 11, without affecting the microwave behavior (generation of additional losses) of the circulator.

The utilization of a long and thin ferrite bar 11 provides for the following advantage. At high frequencies the ferrite material has a high saturation magnetization, and it is difficult to provide required magnetic field intensity by an external magnet. A physical property of a long, thin ferrite bar is that its demagnetization factor is approximately zero. Therefore small magnets are sufficient to produce the required field intensity in the ferrite. Since the magnets 12 and 13 can be placed on the ferrite bar, and no wave conductor walls are located between the ferrite and the magnets 12, 13, the magnetic field in the ferrite bar 11 is increased.

Instead of two magnets on both ends of the ferrite bar, also only one magnet can be arranged on one end side of the ferrite bar. Then there is no current-free separating plane, so that the advantage of a two-shell mounting of the circulator is dispensed with.

The production of the thin ferrite bar is performed preferably from a small parallelepiped which is sawed from big blocks. This manufacturing process is well automateable and therefore can be performed with low expenses.

The ferrite bar 11 with the magnets 12 and 13 fixed at its end sides and having advantageously the same cross-sectional contour as the ferrite bar 11, are inserted in the branching region of the circulator and fixed there in the following manner. A depression 14 formed as a blind hole is provided in the shell 2 of the circulator for receiving an end of the ferrite bar 11 with the magnet 13. The depression 14 has a narrowest possible tolerance to the cross-section of the ferrite bar 11 and matches the magnet 13, to provide the ferrite bar 11 with an exact position inside the branching region 7. An opening 15 is provided in the shell 1 opposite to the depression 14. The ferrite bar 11 with its magnets 12 and 13 can be inserted through the opening 15 from outside into the branching region 7 of the assembled shells 1 and 2. The opening 15 has a certain gap relative to the ferrite bar 11. Therefore the ferrite bar 11 with its magnets 12 and 13 can be inserted without problems into the branching region 7, even when the both shells 1 and 2 of the circulator are assembled with a slight offset relative to one another.

In order to hold the ferrite bar 11 with its magnets 12 and 13 centrally in the branching region 7 despite the gaps in the opening 14, an elastic ring 16 is placed around the end of the ferrite bar 11 or the magnet 12 located in the opening 15. For receiving the ring, the opening 15 in its upper region has a cross-section widening 17. The elastic ring 16 (for example a silicone ring) is pressed between the outer periphery of the magnet 12 and the inner wall of the cross-section-increased region 17 of the opening 15. Thereby the ferrite bar 11 with its magnets 12 and 13 is fixed in the branching region 7. However, a mechanical expansion in the direction of the longitudinal axis of the ferrite bar 11 is possible, which is adjusted by different expansion coefficients of the ferrite bar 1, the magnets 12, 13 and the waveguide wall.

It will be understood that each of the elements described above, or two or more together, may also find a useful application in other types of constructions differing from the types described above.

While the invention has been illustrated and described as embodied in E-plane waveguide circulator, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An E-plane waveguide junction circulator, comprising circulator arms; a height reducing branching region where said circulator arms are joined; a ferrite body located in said branching region so that a magnetic field extends through said ferrite body, said ferrite body being formed as a bar which extends through a total height of said branching region; and at least one permanent magnet placed directly on an end side of said ferrite bar.

2. An E-plane waveguide junction circulator, comprising a height reducing branching region where arms of the circulator join; a ferrite body located in said branching region so that a magnetic field extends through said ferrite body, said ferrite body being formed as a bar which extends through a total height of said branching region; and at least one web extending in said branching region.

3. An E-plane waveguide junction circulator, comprising a height reducing branching region where arms of the circulator join; a ferrite body located in said branching region so that a magnetic field extends through said ferrite body, said ferrite body being formed as a bar which extends through a total height of said branching region; and a plurality of webs extending in said branching region.

4. An E-plane waveguide junction circulator, comprising a height reducing branching region where arms of the circulator join; a ferrite body located in said branching region so that a magnetic field extends through said ferrite body, said ferrite body being formed as a bar which extends through a total height of said branching region; and a circulator body composed of two shells with a separating plane extending transversely to a longitudinal axis of said ferrite bar, one of said shells being provided with a depression for receiving one end of said ferrite bar, while the other of said shells is provided with an opening located opposite to said depression so that said ferrite bar can be inserted into said branching region from outside through said opening.

5. An E-plane waveguide junction circulator as defined in claim 4; and further comprising an elastic ring which surrounds said ferrite bar and fixes said ferrite bar in said opening.

6. An E-plane waveguide junction circulator as defined in claim 4, wherein said depression is formed so that it corresponds with a narrow tolerance to a cross-section of a ferrite bar, said opening being formed so that it has a small gap relative to the cross-section of said ferrite bar.

* * * * *